US008186787B2

(12) United States Patent
Holbrook et al.

(10) Patent No.: US 8,186,787 B2
(45) Date of Patent: May 29, 2012

(54) METHOD AND APPARATUS FOR PRINTING ON VARIABLE THICKNESS PRINT MEDIA

(75) Inventors: Russell W. Holbrook, Southbury, CT (US); Daniel Vetter J. Williams, Woodbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/966,189

(22) Filed: Dec. 13, 2010

(65) Prior Publication Data

US 2011/0074844 A1 Mar. 31, 2011

Related U.S. Application Data

(63) Continuation of application No. 11/963,894, filed on Dec. 24, 2007, now abandoned.

(51) Int. Cl.
*B41J 25/308* (2006.01)
*B41J 29/38* (2006.01)
*B41J 11/20* (2006.01)

(52) U.S. Cl. ..... 347/8; 347/16; 400/56; 400/58

(58) Field of Classification Search ..... 347/8; 400/56, 400/58

See application file for complete search history.

(56) References Cited

U.S. PATENT DOCUMENTS

| | | | | |
|---|---|---|---|---|
| 3,680,681 | A * | 8/1972 | Burk | 198/349 |
| 5,065,169 | A | 11/1991 | Vincent et al. | |
| 5,444,468 | A * | 8/1995 | Fukushima et al. | 347/14 |
| 5,668,581 | A * | 9/1997 | Tsuji et al. | 347/104 |
| 5,757,389 | A * | 5/1998 | Schwede et al. | 347/8 |
| 5,854,643 | A * | 12/1998 | Katsuyama | 347/8 |
| 2002/0018097 | A1 * | 2/2002 | Kitahara et al. | 347/42 |
| 2003/0127792 | A1 | 7/2003 | Engato | |
| 2003/0137573 | A1 * | 7/2003 | Rasmussen et al. | 347/104 |
| 2005/0030327 | A1 | 2/2005 | Tatsumi | |
| 2005/0212838 | A1 * | 9/2005 | Nakashima | 347/8 |
| 2007/0247505 | A1 * | 10/2007 | Isowa et al. | 347/101 |

* cited by examiner

*Primary Examiner* — Shelby Fidler
(74) *Attorney, Agent, or Firm* — Michael J. Cummings; Steven J. Shapiro; Charles R. Malandra, Jr.

(57) ABSTRACT

A method for printing information on a print medium, such as a mailpiece, that includes determining a thickness of the medium while it is being transported toward a print head, such as an ink jet print head, causing the distance between the top surface of the medium the print head when the medium is located below the print head to be within a specified range based on the determined thickness, and printing the information on the print medium. Also, an apparatus includes a printing station having a print head, a transport mechanism for transporting the medium toward the printing station, and a thickness measuring mechanism. The apparatus is structured to cause the distance between the top surface of the medium and a portion of the print head when the medium is located below the print head to be within a specified distance range based on the thickness of the medium.

8 Claims, 4 Drawing Sheets

METHOD AND APPARATUS FOR PRINTING ON VARIABLE THICKNESS PRINT MEDIA

FIELD OF THE INVENTION

The present invention relates to systems that print information on variable thickness print media and, more particularly, to mail processing systems for printing on mailpieces having varying thicknesses.

BACKGROUND OF THE INVENTION

A variety of mail processing and handling devices and systems utilize ink jet printing technology to print information, such as, without limitation, various images, postal indicia (which may include a two-dimensional barcode) and address information, on mailpieces. For example, inserter systems used by organizations such as banks, insurance companies, and utility companies for producing large volume mailings often use ink jet printing technology to print such information on the mailpieces that are being prepared. Such inserter systems resemble an assembly line and transport the mailpieces to a number of different workstations, which may include one or more printing stations, to cooperatively produce finished mailpieces.

Ink jet printers are well known in the art, and generally include one or more arrays of nozzles (sometimes referred to as orifices), a supply of ink, a plurality of ejection elements (for example, expanding vapor bubble elements or piezoelectric transducer elements) corresponding to the nozzles and suitable driver and control electronics (referred to as a print head controller) for controlling the ejection elements. Typically, the one or more arrays of nozzles and the ejection elements along with their associated components are referred to as a print head. It is the activation of the ejection elements that causes drops of ink to be expelled from the nozzles toward the print medium to collectively form a print image.

Because ink jet printing technology inherently has a narrow depth of field requirement in order to obtain an acceptable image, printing on mailpieces or other media using ink jet printing technology requires that the media be accurately positioned such that the surface to be printed is spaced from the print nozzles of the print head within a narrow range. This distance range may need to be held, for example, to between approximately 0.04 inches to approximately 0.08 inches. If the distance between the print head and the media surface varies out of the specified range, the printed image that results will likely be of poor quality and often deemed unacceptable.

Thus, maintaining the proper distance between the print head and the surface of a medium may be significant in mail processing devices and systems, where the thickness of mailpieces may vary from approximately 0.06 inches to approximately 2 inches. Mailpieces may also require higher printing resolutions to produce more advanced graphics.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In one embodiment, the present invention provides method of printing information on variable thickness print media. Specifically, a method is provided for printing information on a print medium, such as a mailpiece, including determining a thickness of the print medium while the print medium is being transported toward a printing station having a print head, such as an ink jet print head, causing a distance between a top surface of the print medium and a portion of the print head, such as the nozzles, when the print medium is located below the print head to be within a specified distance range based on the determined thickness, and printing the information on the print medium when the print medium is located below the print head. As used herein, "mail" and "mailpiece" refer to all items sent through the postal service and other commercial delivery services, including post cards, envelopes, packages of all sizes, and other items.

In one particular embodiment, the method includes moving the print head relative to a plane on which the print medium is being transported based on the determined thickness. The moving step may comprise moving the print head relative to a surface on which the print medium is supported while the print medium is located below the print head. Alternatively, the print medium may be supported on a surface while the print medium is located below the print head and the method may include moving the surface relative to the print head based on the determined thickness. The method may further include scanning the information that is printed on the print medium.

In another embodiment, the invention provides an apparatus for printing information on variable thickness print media. In particular, the invention provides an apparatus for printing information on a print medium, such as a mailpiece, that includes a printing station having a print head, such as an ink jet print head, a transport mechanism for transporting the print medium toward the printing station, and a thickness measuring mechanism for determining a thickness of the print medium at a location upstream from the printing station. The apparatus is structured to cause a distance between a top surface of the print medium and a portion of the print head, such as the nozzles, for example, when the print medium is located below the print head to be within a specified distance range based on the thickness of the print medium that is determined by the thickness measuring mechanism.

In one particular embodiment, the transport mechanism is a variable height transport mechanism including a support surface on which the print medium is supported while the print medium is located below the print head, wherein the variable height transport mechanism is structured to enable a height of the support surface to be selectively adjusted. The apparatus may include a motor operatively coupled to the variable height transport mechanism for selectively adjusting the height of the support surface.

The variable height transport mechanism may comprise a belt transport mechanism including a first transport belt, a second transport belt, a third transport belt, a fourth transport belt, a fifth transport belt, a first shaft, a second shaft, a third shaft and a fourth shaft. The first transport belt and the second transport belt are operatively coupled to the first shaft, the second transport belt and the third transport belt are operatively coupled to the second shaft, the third transport belt and the fourth transport belt are operatively coupled to the third shaft, and the fourth transport belt and the fifth transport belt are operatively coupled to the fourth shaft. The variable height transport mechanism in this embodiment is structured to enable a height of the second shaft, the third shaft and the third transport belt to be selectively adjusted. The thickness measuring mechanism may be a contact paddle attached to a rotary encoder.

In another particular embodiment, transport mechanism includes a support surface on which the print medium is supported while the print medium is located below the print head, wherein the print head is selectively movable toward and away from the support surface. The apparatus may include a motor operatively coupled to the print head for selectively moving the print head.

In either particular embodiment, the thickness measuring mechanism may be a contact paddle attached to a rotary encoder. In addition, either particular embodiment may further include a top transport belt located adjacent to the print head that is structured to contact the top surface of the print medium to assist in transporting the print medium. A scanner located at the printing station may also be provided for scanning the information that is printed on the print medium. In some embodiments, scanning may be used for verification of image quality and other purposes, such as tracking of mailpieces, for example.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings illustrate exemplary embodiments of the invention, and together with the general description given above and the detailed description given below, serve to explain the principles of the invention. As shown throughout the drawings, like reference numerals designate like or corresponding parts.

DESCRIPTION OF EXEMPLARY EMBODIMENTS

Embodiments of the invention are discussed herein with reference to mail processing systems. However, other embodiments of the invention may be employed in other paper handling systems in which information is printed on print media having varying thickness using, for example, ink jet printing technology, as well as in other web handling systems using a variety of printing technologies.

Figure 1A:
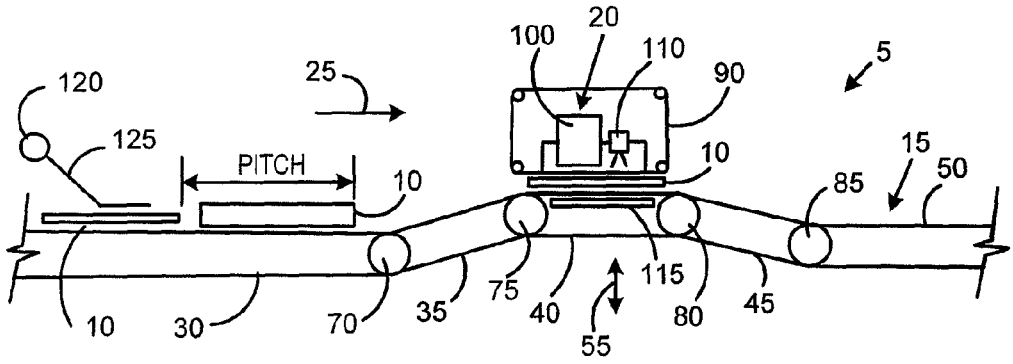
FIGS. 1A and 1B are schematic illustrations of a portion of a mail processing system according to one embodiment of the present invention.
Figure 1B:
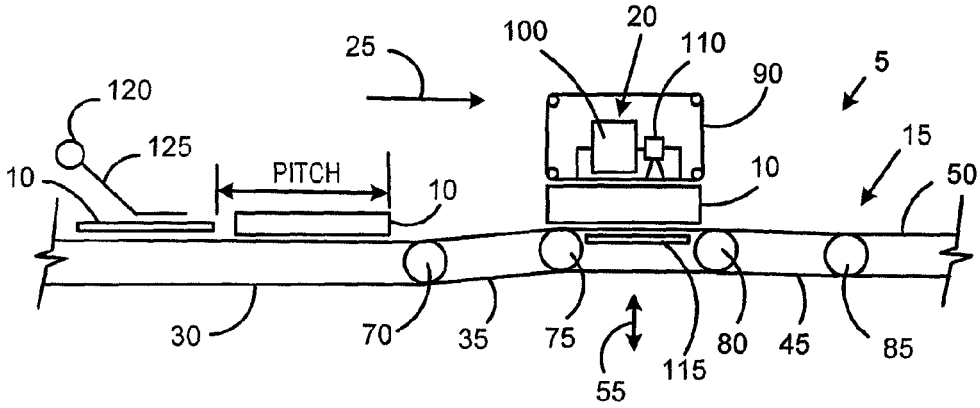
Figure 2:
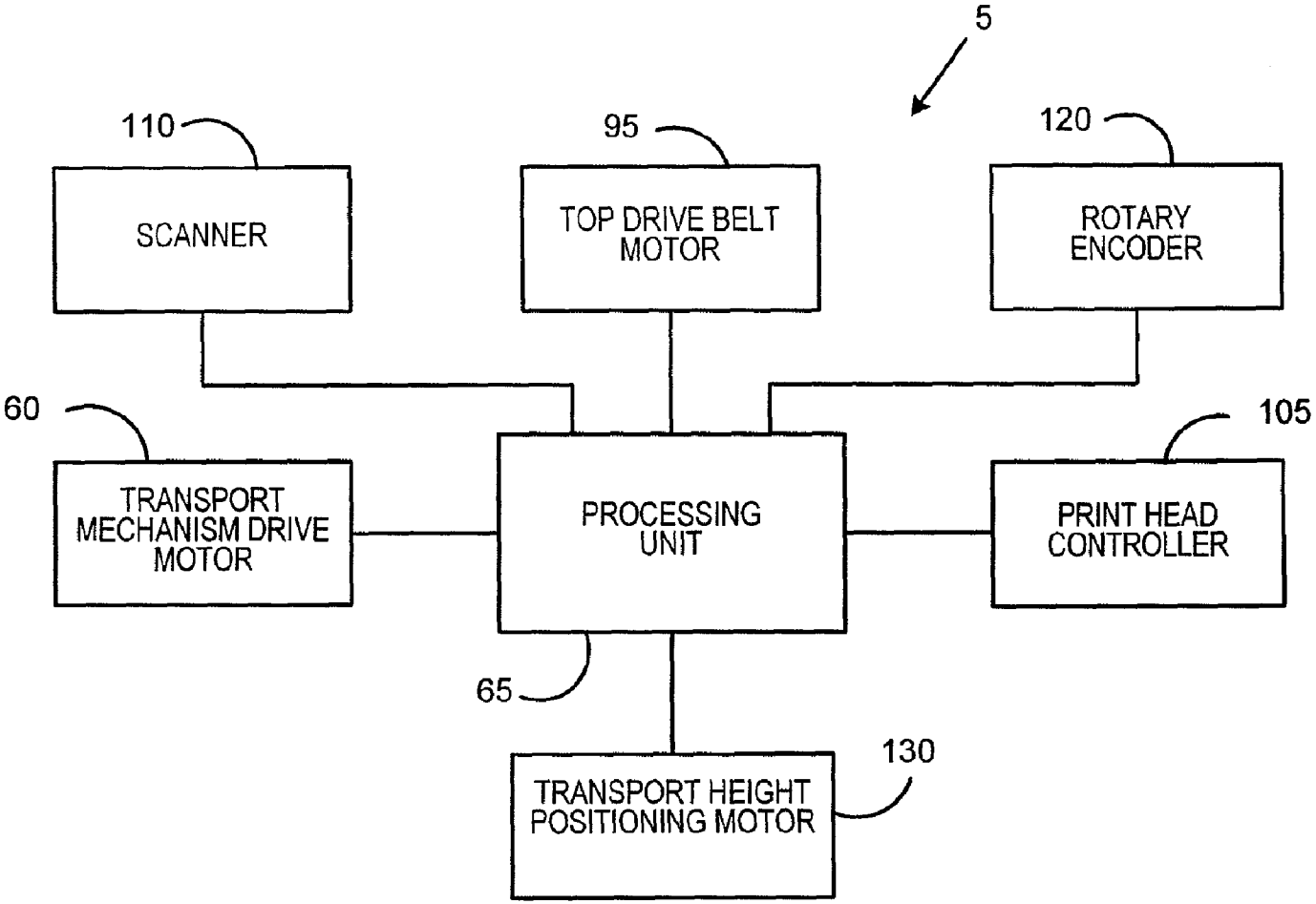
FIG. 2 is a block diagram of selected components of the mail processing system shown in FIGS. 1A and 1B.

FIGS. 1A and 1B are schematic illustrations of a portion of a mail processing system 5 according to one embodiment of the present invention. FIG. 2 is a block diagram of selected components of the mail processing system 5 shown in FIGS. 1A and 1B. As described in detail herein, the mail processing system 5 enables information to be printed using ink jet technology on mailpieces 10 that have varying thickness in a manner that ensures a high print quality. FIG. 1A shows the configuration of the processing system 5 when a relatively thin mailpiece 10 is being printed upon, and FIG. 1B shows the configuration of the processing system 5 when a relatively thicker mailpiece 10 is being printed upon.

As seen in FIGS. 1A and 1B, the mail processing system 5 includes a variable height transport mechanism 15 for transporting the mailpieces 10 toward a printing station 20 in the direction of the arrow 25. The variable height transport mechanism 15 includes a first transport belt 30, a second transport belt 35, a third transport belt 40, a fourth transport belt 45, and a fifth transport belt 50. As described in detail herein, the third transport belt 40 is positioned beneath the printing station 20 and is able to be selectively moved toward and away from the printing station 20 as indicated by the arrow 55.

The first end of the first transport belt 30 is operatively coupled to and driven by a drive shaft (not shown), which in turn is driven by a transport mechanism drive motor 60, such as a servo motor, for example, under the control of a processing unit 65 of the mail processing system 5, shown in FIG. 2. In particular, the processing unit 65 controls the velocity of the transport mechanism drive motor 60, which in turn controls the velocity of the first transport belt 30 and therefore the velocity at which the mailpieces 10 are transported toward the printing station 20.

As seen in FIGS. 1A and 1B, the mail processing system 5 includes a four-bar linkage comprising driven shafts 70, 75, 80, and 85 to ensure that the variable height transport mechanism 15 moves parallel to the bottom surface of the printing station 20 and the platform 115 on which the mailpieces 10 rest when printing occurs. In particular, the first transport belt 30 is operatively coupled to the driven shaft 70, the second transport belt 35 is operatively coupled to the driven shaft 70 and the driven shaft 75, the third transport belt 40 is operatively coupled to the driven shaft 75 and the driven shaft 80, and the fourth transport belt 45 is operatively coupled to the driven shaft 80 and the driven shaft 85. Finally, the fifth transport belt 45 is operatively coupled to the driven shaft 85 and feeds the mailpieces to a subsequent processing area of the mail processing system 5, which may take on any of a number of forms which are not relevant to the present description and will therefore not be described further.

A top drive belt mechanism 90 is provided in the immediate printing area between the printing station 20 and the mailpieces 10 being printed to ensure that the mailpieces 10 track to the transport velocity of the transport mechanism drive motor 60 and, therefore, to ensure that accurate images are printed. The top drive belt mechanism 90 is driven by a top drive belt motor 95, such as a servo motor, for example, which is operatively coupled to and under the control of the processing unit 65 (FIG. 2).

The printing station 20 includes an ink jet print head 100, which is controlled by a print head controller 105 (FIG. 2). The print head controller 105 is operatively coupled to and under the control of the processing unit 65. The printing station 20 further includes a scanner 110 which is located downstream from the ink jet print head 100. The scanner 110 is operatively coupled to and under the control of the processing unit 65. The scanner 110 is adapted to capture images of the information that is printed by the ink jet print head 100 and provide those images to the processing unit 65 so that the processing unit 65 can verify that the information has been printed correctly and/or verify certain data that has been printed on or is otherwise on the mailpieces 10. The scanner 110 may take on any suitable form, such as, without limitation, a camera, a moving beam, or other suitable imaging technology.

The mail processing system 5 also includes a mechanism for measuring the thickness of each mailpiece 10 that is located upstream from the printing station 20. In the embodiment shown in FIGS. 1A and 1B, the thickness measuring mechanism is a rotary encoder 120 that is operatively coupled to a contact paddle 125 which contacts the top surface of each mailpiece 10 as it is being transported on the first transport belt 30. Other devices for measuring the thickness of the medium may also be used. As seen in FIG. 2, the rotary encoder 120 is operatively coupled to the processing unit 65 so that thickness information can be communicated to the processing unit 65.

As discussed elsewhere herein, the variable height transport mechanism 15 is structured so that the third transport belt 40, the platform 115, and the driven shafts 75 and 80, which are positioned beneath the printing station 20, are able to be selectively moved toward and away from the printing station 20, so that the height of the third transport belt 40 and the platform 115 may be selectively adjusted. The movement of the third transport belt 40, the platform 115 and the driven shafts 75 and 80 is controlled by a transport height positioning motor 130 (FIG. 2), such as a servo motor, for example, which is operatively coupled to and under the control of the processing unit 65.

In one embodiment, the transport height positioning motor 130 is disposed on the platform 115. The transport height positioning motor 130 drives a lead screw arrangement to vary the height of the platform 115. Other drive arrangements may also be used. As a result, according to an aspect of the present invention, and based on the determined thickness of each mailpiece 10, the distance band between the top of each mailpiece 10 and a portion of the ink jet print head 100, such as the nozzles, for example, can be controlled so as to be within a predetermined, specified distance range that will result in a high quality printing operation.

In operation, as each mailpiece 10 is fed along the first transport belt 30, the thickness of the mailpiece 10 is determined by the rotary encoder 120. That thickness information is then provided to the processing unit 65. Then, based on the pitch between the mailpieces 10 (see FIGS. 1A and 1B) and the transport velocity of the variable height transport mechanism 15, the processing unit 65 is able to determine when the mailpiece 10 will be positioned under the printing station 20.

In addition, based on the determined thickness information for the mailpiece 10, the processing unit 65 is able to determine a height for the third transport belt 40, the platform 115, and the driven shafts 75 and 80 that will result in the distance between the top surface of the mailpiece 10 and the nozzles of the ink jet print head 100 to be within the specified distance range for quality printing. Thus, when the mailpiece 10 approaches the printing station 20, the transport height positioning motor 130 will, at the appropriate time, cause the third transport belt 40, the platform 115, and the driven shafts 75 and 80 to move to the determined height so that the mailpiece 10 will be properly positioned when printing commences.

FIG. 1A shows the third transport belt 40, the platform 115, and the driven shafts 75 and 80 at a height that is suitable for the relatively thin mailpiece 10 shown in FIG. 1A. FIG. 1B shows the third transport belt 40, the platform 115, and the driven shafts 75 and 80 moved downwardly to a height that is suitable for the thicker mailpiece 10 shown in FIG. 1B.

Furthermore, in some embodiments, when a jam occurs in the mail processing system 5, and in particular at the printing station 20, the transport height positioning motor 130 causes the third transport belt 40, the platform 115, and the driven shafts 75 and 80 to move to a lowermost position (e.g., a height that causes the third transport belt 40, the platform 115, and the driven shafts 75 and 80 to be furthest from the printing station 20), so that the jam may more easily be cleared. In addition, the above-described assembly may also be lowered to the lowermost position in order to allow a mailpiece 10 that is not to have information printed on it to pass freely through the printing station 20, to allow easier adjust of the alignment of the print head 100, and/or to allow more easier cleaning of the print head 100.

Figure 3A:
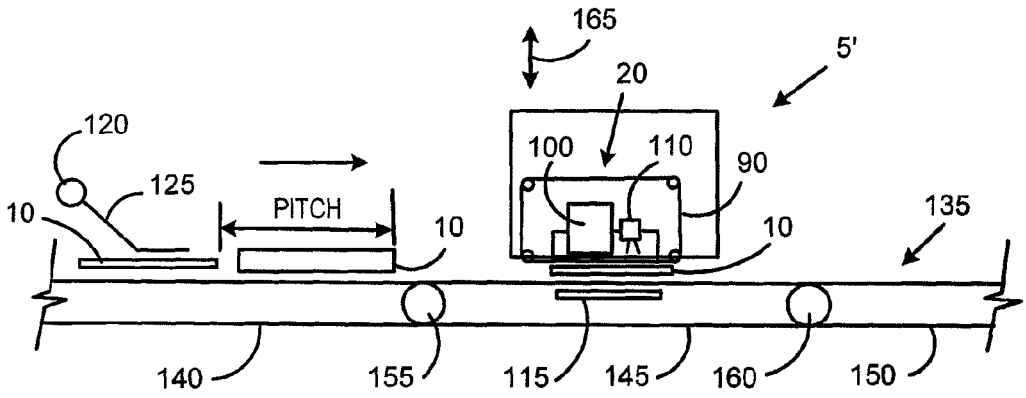
FIGS. 3A and 3B are schematic illustrations of a portion of a mail processing system according to an alternative embodiment of the present invention.
Figure 3B:
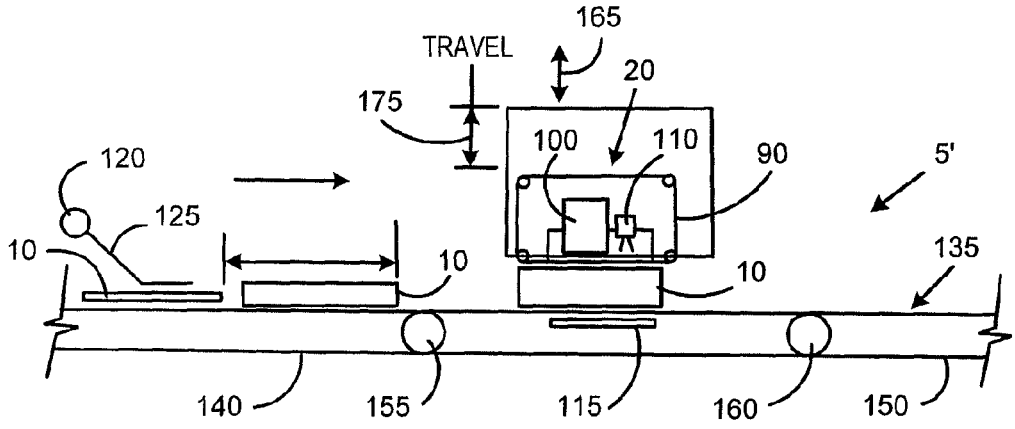
Figure 4:
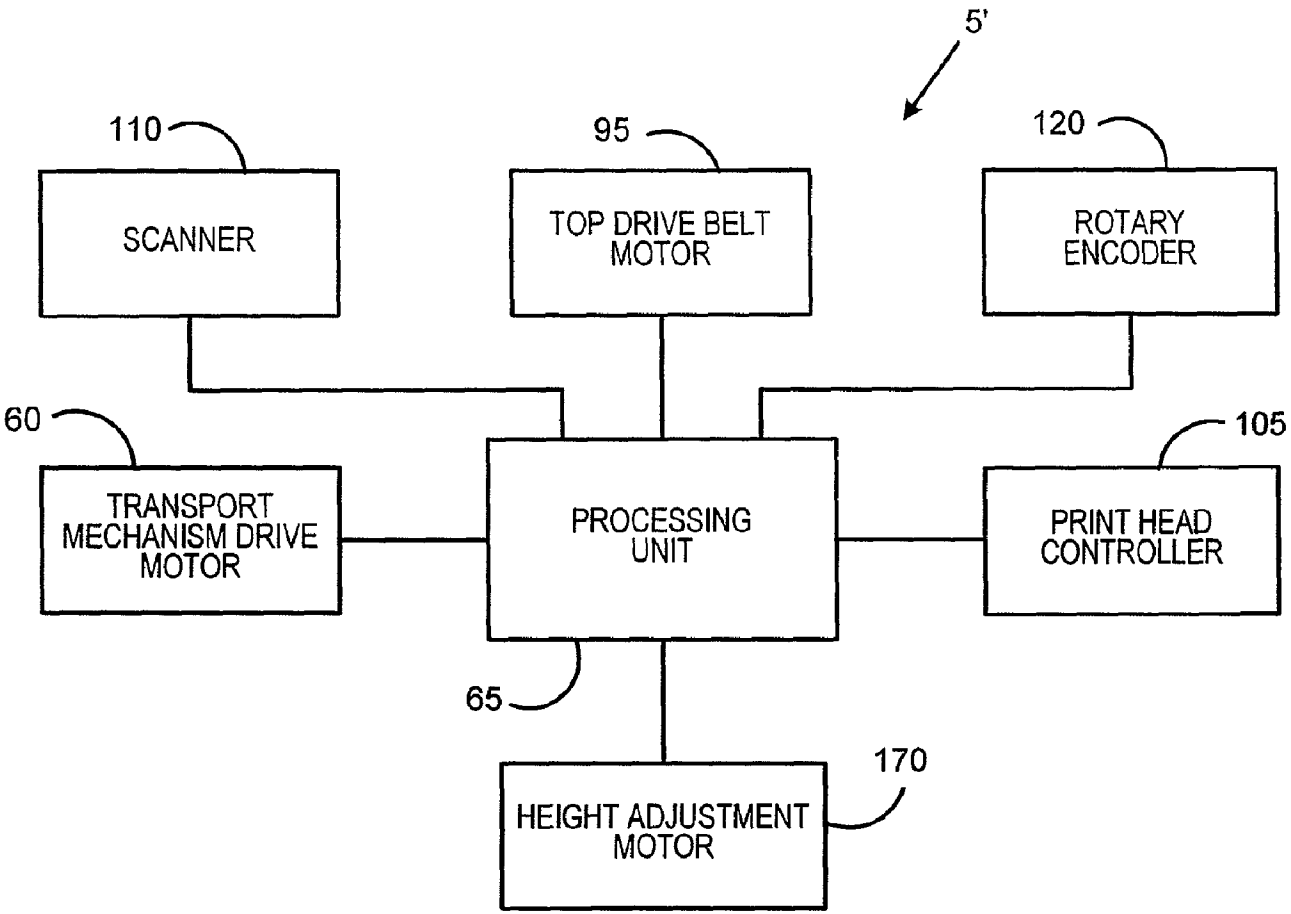
FIG. 4 is a block diagram of selected components of the mail processing system shown in FIGS. 3A and 3B.

FIGS. 3A and 3B are schematic illustrations of a portion of a mail processing system 5' according to an alternative embodiment of the present invention. FIG. 4 is a block diagram of selected components of the mail processing system 5' shown in FIGS. 3A and 3B. Like the mail processing system 5 described above, the mail processing system 5' enables information to be printed using ink jet printing technology on mailpieces 10 that have varying thickness in a manner that promotes a high print quality. FIG. 3A shows the configuration of the processing system 5' when a relatively thin mailpiece 10 is being printed upon, and FIG. 3B shows the configuration of the processing system 5' when a relatively thicker mailpieces 10 is being printed upon.

The mail processing system 5' is structurally similar to the mail processing system 5 and, as seen in FIGS. 3A, 3B, and 4, includes a number of like components. Those like components are referenced in FIGS. 3A, 3B, and 4, using the same reference numerals that were used to identify those components in FIGS. 1A, 1B, and 2.

The mail processing system 5' differs from the mail processing system 5 in the manner in which the distance between the top surface of a mailpiece 10 and the nozzles of the ink jet print head 100 is selectively controlled. In particular, rather than having a variable height transport mechanism 15 that enables the third transport belt 40, the platform 115, and the driven shafts 75 and 80 to be selectively moved, the mail processing system 5' includes a transport mechanism 135 that is maintained at a constant height. Specifically, the transport mechanism 135 includes a first transport belt 140, a second transport belt 145, and a third transport belt 150. As seen in FIGS. 3A and 3B, the second transport belt 145 is positioned beneath the printing station 20. The first transport belt 140 is operatively coupled to and driven by a drive shaft (not shown), which in turn is driven by a transport mechanism drive motor 60 (FIG. 4), such as a servo motor, for example, under the control of a processing unit 65 of the mail processing system 5'.

The first transport belt 140 is also operatively coupled to a driven shaft 155, the second transport belt 145 is operatively coupled to the driven shaft 155 and a driven shaft 160, and the third transport belt 150 is operatively coupled to the driven shaft 160. The third transport belt 150 feeds the mailpieces 10 to a subsequent processing area of the mail processing system 5', which may take on any of a number of forms which are not relevant to the present description and will therefore not be described further. The processing unit 65 controls the velocity of the motor transport mechanism drive motor 60, which in turn controls the velocity of the first transport belt 140 and, therefore, the velocity at which the mailpieces 10 are transported toward the printing station 20.

In the mail processing system 5', the distance between the top surface of a mailpiece 10 and the nozzles of the ink jet print head 100 is controlled by selectively moving the printing station 20 and the top transport belt 90 of the mail processing system 5' relative to the second transport belt 145 and the platform 115 in the directions indicated by the arrow 165.

In particular, as seen in FIG. 4, the mail processing system 5' includes a height adjustment motor 170 that is operatively coupled to the printing station 20 and the top transport belt 90. In one embodiment, the height adjustment motor 170 is disposed on the printing station 120. The height adjustment motor 170 drives a lead screw arrangement to vary the height of the printing station 120. Using a similar drive arrangement, the printing station 120 is movable across the width of the mailpieces (in and out of the page in FIGS. 3A and 3B) to position the print image. Other drive arrangements may also be used. Further, the printing station 120 may be constrained using linear bearings to ensure greater positioning accuracy. Thus, under the control of the processing unit 65, the height adjustment motor 170 is able to selectively adjust the height of the printing station 20 and the top transport belt 90 based on the determined height of each mailpiece 10.

In operation, as each mailpiece 10 is fed along the first transport belt 140, the thickness of the mailpiece 10 is determined by the rotary encoder 120. Other devices for measuring the thickness of the medium may also be used. That thickness information is then provided to the processing unit 65. Then, based on the pitch between the mailpieces 10 (see FIGS. 3A and 3B) and the transport velocity of the transport mechanism 135, the processing unit 65 is able to determine when the mailpiece 10 will be positioned under the printing station 20.

In addition, based on the determined thickness information for the mailpiece 10, the processing unit 65 is able to determine a height for the printing station 20 and the top transport belt 90 that will result in the distance between the top surface of the mailpiece 10 and the nozzles of the ink jet print head 100 to be within the specified distance range for quality printing. Thus, when the mailpiece 10 approaches the printing station 20, the height adjustment motor 170 will, at the appropriate time, cause the printing station 20 and the top transport belt 90 to move to the determined height so that the mailpiece 10 will be properly positioned when printing commences.

FIG. 3A shows the printing station 20 and the top transport belt 90 at a height that is suitable for the relatively thin mailpiece 10 shown in FIG. 3A. FIG. 3B shows the printing station 20 and the top transport belt 90 moved upwardly by a distance indicated by the arrow 175 to a height that is suitable for the thicker mailpiece 10 shown in FIG. 3B.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An apparatus for printing information on a print medium, comprising:

a printing station having a print head;

a transport mechanism for transporting the print medium toward the printing station; and a thickness measuring mechanism for determining a thickness of the print medium at a location upstream from the printing station;

wherein the apparatus is structured to cause a distance between a top face of the print medium and a portion of the print head when the print medium is located below the print head to be within a specified distance range based on a thickness of the print medium determined by the thickness measuring mechanism; and wherein the transport mechanism is a variable height transport mechanism including a support surface on which the print medium is supported while the print medium is located below the print head, and wherein the variable height transport mechanism is structured to enable a height of the support surface to be selectively adjusted; and wherein the variable height transport mechanism is a series of linked, flexibly coupled, transport belt assemblies, the linked transport belt assemblies including a first transport belt, a second transport belt, a third transport belt, a fourth transport belt, a fifth transport belt, a first shaft, a second shaft, a third shaft and a fourth shaft, wherein the first transport belt and the second transport belt are pivotally coupled to the first shaft, wherein the second transport belt and the third transport belt are pivotally coupled to the second shaft, wherein the third transport belt and the fourth transport belt are pivotally coupled to the third shaft, and wherein the fourth transport belt and the fifth transport belt are pivotally coupled to the fourth shaft, and wherein the variable height transport mechanism is structured to enable a height of the second shaft, the third shaft and the third transport belt to be selectively adjusted, while the second and fourth transport belts, linked to the third transport belt, can be flexibly tilted to form ramps to and from the height adjusted third transport belt.

2. The apparatus according to claim 1, further comprising a motor operatively coupled to the variable height transport mechanism for selectively adjusting the height of the support surface.

3. The apparatus according to claim 1, wherein the support surface is a platform located adjacent to the third transport belt.

4. The apparatus according to claim 1, wherein the thickness measuring mechanism comprises a contact paddle attached to a rotary encoder.

5. The apparatus according to claim 1, further comprising a top transport belt located adjacent to the print head, the top transport belt being structured to contact the top surface of the print medium to assist in transporting the print medium.

6. The apparatus according to claim 1, further comprising a scanner located at the printing station for scanning the information that is printed on the print medium.

7. The apparatus according to claim 1, wherein the print head is an ink jet print head and wherein the portion of the print head is a plurality of nozzles of the print head.

8. The apparatus according to claim 1, wherein the apparatus is a mail processing system and wherein the print medium comprises a mailpiece.

* * * * *